US008887444B2

(12) United States Patent
Kalempa et al.

(10) Patent No.: US 8,887,444 B2
(45) Date of Patent: Nov. 18, 2014

(54) DOOR ASSEMBLY AND METHOD OF MAKING SAME (STAINLESS STEEL SLIDING DOOR)

(75) Inventors: Walenty Kalempa, Slinger, WI (US); Arno Klien, Nordstemmen (DE); David Slomski, Jackson, WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 12/369,482

(22) Filed: Feb. 11, 2009

(65) Prior Publication Data

US 2009/0145038 A1 Jun. 11, 2009

Related U.S. Application Data

(62) Division of application No. 11/161,167, filed on Jul. 25, 2005, now abandoned, and a division of application No. 12/369,465, filed on Feb. 11, 2009, now Pat. No. 8,839,563, and a division of application No. 12/369,494, filed on Feb. 11, 2009, now abandoned, and a division of application No. 12/369,517, filed on Feb. 11, 2009, now abandoned.

(60) Provisional application No. 60/590,859, filed on Jul. 24, 2004.

(51) Int. Cl.

| | |
|---|---|
| ***E06B 3/00*** | (2006.01) |
| ***E06B 3/46*** | (2006.01) |
| ***E06B 7/23*** | (2006.01) |
| ***E06B 3/82*** | (2006.01) |

(52) U.S. Cl.

CPC ..... *E06B 7/2309* (2013.01); *E06B 3/4636* (2013.01); *E06B 3/822* (2013.01)

USPC ..... 49/501; 49/409

(58) Field of Classification Search

USPC ..... 49/409, 410, 411, 425, 501; 52/204.51, 52/208, 455, 784.1, 207, 656.4, 656.5, 52/656.6, 656.7; 16/87 R, 91, 94 R, 95 R, 16/97–104, 106, 107; 428/44, 57, 70, 150, 428/409

See application file for complete search history.

(56) References Cited

U.S. PATENT DOCUMENTS

| | | | | |
|---|---|---|---|---|
| 1,592,408 | A | 7/1926 | Zahner | |
| 1,694,522 | A | 12/1928 | Victor | |
| 2,118,032 | A | 5/1938 | Gibson | |
| 2,761,533 | A * | 9/1956 | Grossman | 49/411 |
| 2,929,622 | A | 3/1960 | Thorson | |
| 2,948,366 | A | 8/1960 | Kelly et al. | |
| 2,977,645 | A | 4/1961 | Tysdal | |
| 3,177,989 | A * | 4/1965 | Di Chiaro | 49/425 |
| 3,384,998 | A | 5/1968 | Abramson | |
| 3,460,290 | A * | 8/1969 | Wutzke | 49/411 |
| 3,473,266 | A * | 10/1969 | Miller | 49/504 |
| 3,709,533 | A * | 1/1973 | Walters | 49/409 |
| 3,816,011 | A * | 6/1974 | Biebuyck et al. | 403/187 |
| 3,879,894 | A * | 4/1975 | Anderson | 49/420 |

(Continued)

*Primary Examiner* — Katherine Mitchell
*Assistant Examiner* — Catherine A Kelly
(74) *Attorney, Agent, or Firm* — Factor Intellectual Property Law Group, Ltd.

(57) ABSTRACT

The present invention is directed to a door panel preferably for a sliding door assembly. The door panel includes an inner frame and a sheet stock substantially covering the inner frame. The inner frame includes a geometry that cooperates with a geometry of a door accessory for operable connection of the door accessory directly to the inner frame.

8 Claims, 5 Drawing Sheets

(56) References Cited

U.S. PATENT DOCUMENTS

| | | | | | |
|---|---|---|---|---|---|
| 4,081,880 | A | | 4/1978 | Edeus | |
| 4,126,912 | A | * | 11/1978 | Johnson | 16/81 |
| 4,227,346 | A | | 10/1980 | Kubik | |
| 4,461,519 | A | | 7/1984 | Hildebrandt et al. | |
| 4,722,146 | A | | 2/1988 | Kemeny | |
| 4,850,078 | A | * | 7/1989 | Libby et al. | 16/100 |
| 4,850,144 | A | | 7/1989 | Grisham et al. | |
| 4,873,741 | A | * | 10/1989 | Riegelman | 16/105 |
| 4,922,658 | A | | 5/1990 | Coddens | |
| 4,947,597 | A | | 8/1990 | Simpson | |
| 4,956,952 | A | * | 9/1990 | Bancroft | 52/207 |
| 5,115,596 | A | | 5/1992 | Fevold et al. | |
| 5,184,423 | A | | 2/1993 | McCarty | |
| 5,193,310 | A | | 3/1993 | Kiel | |
| 5,197,225 | A | | 3/1993 | Yff | |
| 5,224,297 | A | | 7/1993 | Watkins | |
| 5,325,648 | A | | 7/1994 | Menard | |
| 5,351,442 | A | | 10/1994 | Gingras | |
| 5,459,972 | A | | 10/1995 | Eckel | |
| 5,511,352 | A | | 4/1996 | Sholton | |
| 5,791,089 | A | * | 8/1998 | Prevot et al. | 49/425 |
| 5,839,252 | A | * | 11/1998 | Berghorn et al. | 52/784.13 |
| 5,845,363 | A | * | 12/1998 | Brempell et al. | 16/105 |
| 5,860,264 | A | | 1/1999 | Gephart et al. | |
| 5,941,032 | A | | 8/1999 | Lydon | |
| 6,026,612 | A | * | 2/2000 | Strassel et al. | 49/425 |
| 6,029,411 | A | | 2/2000 | Richardson | |
| 6,105,322 | A | | 8/2000 | Chang | |
| 6,131,340 | A | | 10/2000 | Clark et al. | |
| 6,148,451 | A | | 11/2000 | DeBraal et al. | |
| 6,151,849 | A | | 11/2000 | Twigg et al. | |
| 6,338,227 | B1 | | 1/2002 | Finke | |
| 6,393,782 | B1 | | 5/2002 | Berridge et al. | |
| 6,550,217 | B2 | | 4/2003 | Heung-Bin | |
| 6,687,954 | B2 | * | 2/2004 | Zingg | 16/97 |
| 6,804,920 | B2 | | 10/2004 | Hogan | |
| 6,877,289 | B2 | | 4/2005 | Yao et al. | |
| 6,928,776 | B2 | | 8/2005 | Homung | |
| 7,023,162 | B2 | | 4/2006 | Robb et al. | |
| 7,228,659 | B2 | | 6/2007 | Romero et al. | |
| 7,430,836 | B2 | | 10/2008 | Sibbett | |
| 7,520,090 | B2 | * | 4/2009 | Gerhart | 49/425 |
| 7,555,871 | B1 | | 7/2009 | Neal | |
| 2004/0065019 | A1 | | 4/2004 | Haab et al. | |
| 2004/0074207 | A1 | | 4/2004 | Yao et al. | |
| 2004/0177585 | A1 | | 9/2004 | Vermette | |
| 2005/0016073 | A1 | | 1/2005 | Petta et al. | |
| 2005/0150168 | A1 | | 7/2005 | Romero et al. | |
| 2006/0150524 | A1 | | 7/2006 | Kibbel et al. | |
| 2006/0230684 | A1 | | 10/2006 | Poole | |
| 2006/0277850 | A1 | | 12/2006 | Gravel et al. | |
| 2007/0022667 | A1 | | 2/2007 | Olofsson | |

* cited by examiner

FIG. 3A
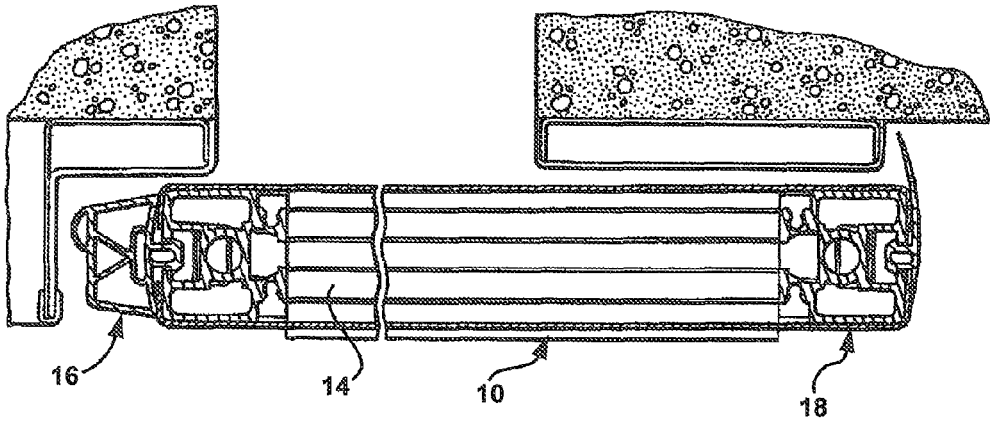
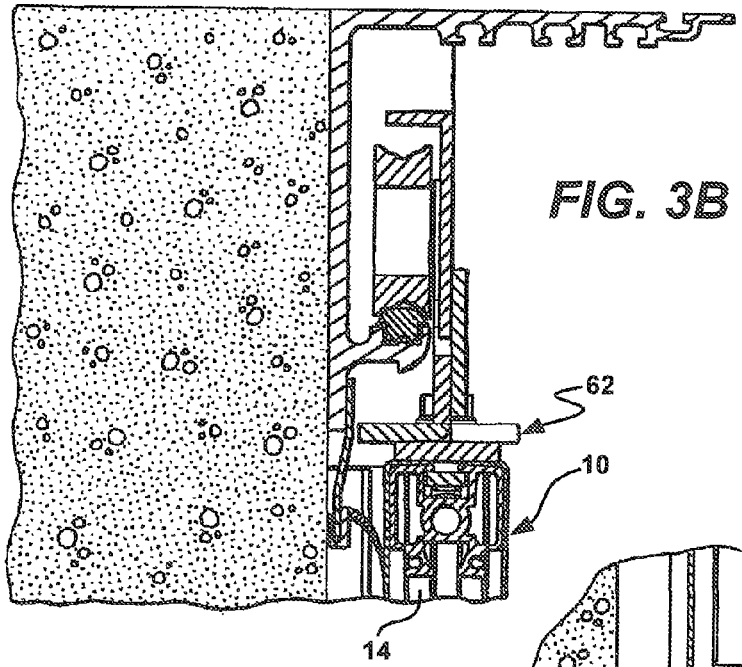
FIG. 3B
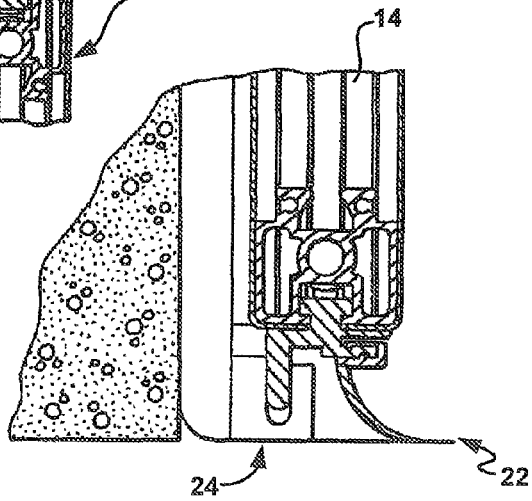
FIG. 3C

DOOR ASSEMBLY AND METHOD OF MAKING SAME (STAINLESS STEEL SLIDING DOOR)

CROSS-REFERENCE TO RELATED APPLICATIONS

This application is a divisional application of U.S. application Ser. No. 11/161,167, which claims priority to U.S. Provisional Patent Application Ser. No. 60/590,859 entitled, "Improved Door Assembly and Method," filed Jul. 24, 2004, the contents of which are incorporated herein by reference. This application is related to further divisional applications: U.S. patent application Ser. No. 12/369,465, entitled DOOR ASSEMBLY AND METHOD OF MAKING SAME; U.S. patent application Ser. No. 12/369,494, entitled DOOR ASSEMBLY AND METHOD OF MAKING SAME; and, U.S. patent application Ser. No. 12/369,517, entitled DOOR ASSEMBLY AND METHOD OF MAKING SAME; all of which were simultaneously filed on Feb. 11, 2009.

TECHNICAL FIELD

The present invention relates to door panels and door assemblies. More specifically, the present invention involves the structure and assembly of a door panel, and assemblies for operation of the door panels.

BACKGROUND OF THE INVENTION

Many factors are considered during the design of a product intended for commercial or industrial use. Such factors include, and are not limited to: time, cost, safety, manufacturability, repairability, quality, and intended use.

Design considerations relating to a product's manufacturability involve: use of components across various product lines, inventory and availability of components, tooling, part count, and product complexity and installation. The utilization of common component parts throughout a product line may save costs, thus facilitating the installation and assembly of the product to improve its marketability.

The present invention is provided to address these and other considerations.

SUMMARY OF THE INVENTION

The present invention is directed to improving the utility of a door panel. One embodiment of the present invention includes a door panel for a slidable door assembly. The door panel comprises an inner frame and a sheet stock substantially covering the inner frame. The inner frame includes a geometry that cooperates with a geometry of one or more door accessories to facilitate connection of the door accessory directly to the inner frame.

Another aspect of the present invention is directed to a method of manufacture of a door panel for a slidable door assembly. A plurality of frame members are connected together to form an inner frame assembly. Each of the plurality of frame members includes an identical cross-section. Sheet stock is attached to the inner frame assembly and folded over is edge(s). A door accessory may be directly attached to one of the frame members and capable of further overlapping the sheet stock.

A further aspect of the present invention is directed to a gasket for sealing a window in a door assembly including a transparent member and both a frame member and a sheet stock covering the door. The transparent member is substantially parallel with the sheet stock. The gasket includes a first sealing portion including a proximate end and a distal end, wherein a terminal portion of the proximate end terminating substantially flush or coplanar with an outer surface of the sheet stock. A second sealing portion extends from the distal end of the first sealing portion and is substantially parallel to the transparent member.

A still further aspect of the present invention is a door panel for a door assembly. The door panel includes an inner frame having an outer face surface and an outer edge surface. A sheet stock substantially covers the outer face surface and at least a portion of the outer edge surface of the inner frame.

Yet a further aspect of the present invention is directed to a guide for a slidable door assembly including a header support and a vertical support for the header. The guide maintains alignment of a door panel during sliding movement of the door panel. The guide comprises a first coupling member and a second coupling member. The first coupling member is operably attached to the door panel and the second coupling member is operably attached to the vertical support wherein the first coupling member and the second coupling member cooperate to maintain alignment of the door panel during movement of the door.

Yet a still further aspect of the present invention is directed to a door panel for a door assembly including a drive system. The door panel comprises an inner frame including a geometry and a trolley including a geometry that cooperates with the geometry of the inner frame for connection of the trolley directly to the inner frame.

Yet another aspect of the present invention is directed an extruded member for use in constructing an inner frame of a door panel for a door assembly. The extruded member includes a length, a first side, and a second side, wherein the extruded member comprises at least one of either a first protrusion or a first receptacle formed in at least one of the first and second sides. The first protrusion or first receptacle is located and dimensioned to cooperate with a mating receptacle or protrusion attached to a door seal operably connected to the inner frame.

Yet another still further aspect of the present invention is directed to an inner frame for a door panel of a door system. The inner frame is constructed of a plurality of frame members cut from a single extruded member. The frame members have a length, a first side, and a second side. At least one of either a first protrusion or a first receptacle is formed in at least one of the first and second sides. The first protrusion or first receptacle is located and dimensioned to cooperate with an accessory connected to the inner door frame, wherein the accessory includes a mating receptacle or protrusion.

Other advantages and aspects of the present invention will become apparent upon reading the following description of the drawings and detailed description of the invention.

BRIEF DESCRIPTION OF THE DRAWINGS

FIGS. 3A-3C are partial views of cross-sections of a door assembly including a door panel of the present invention and a variety of door accessories capable of being operably attached thereto;

DETAILED DESCRIPTION

Figure 1A:
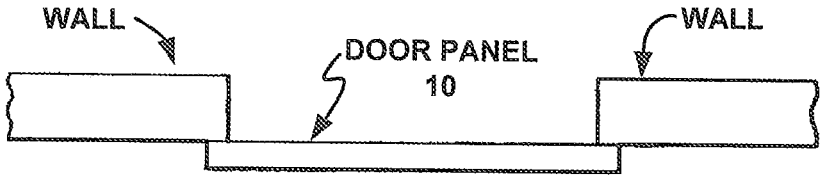
FIGS. 1A and 1B are schematics depicting a partial top view of a slidable door assembly incorporating a single and a bi-parting door panel assembly of the present invention, respectively.

While the present invention is capable of embodiment in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

Figure 1B:
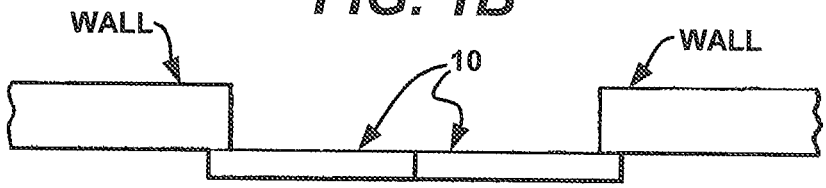

FIGS. 1A and 1B are schematic top views single and bi-parting slidable door assemblies wherein door panel(s) 10 laterally slide back and forth to provide access to selectively allow passage through an opening defined proximate the slidable door assembly.

Figure 2:
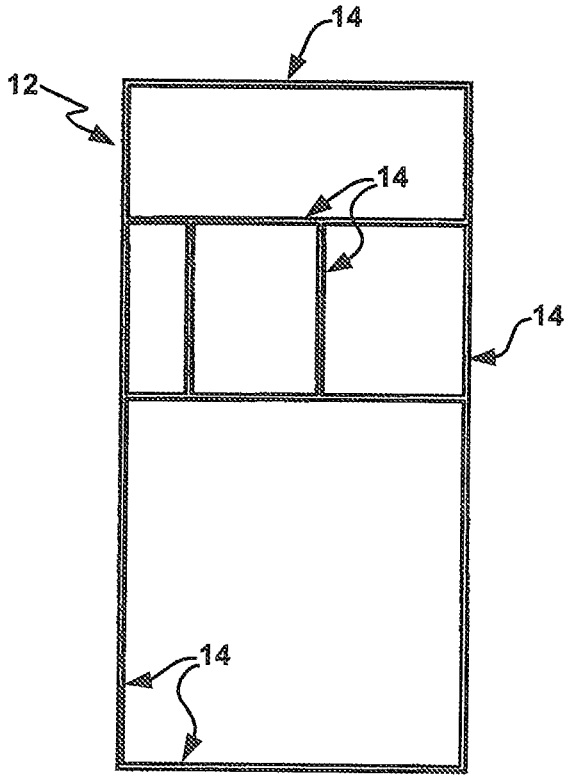
FIG. 2 is a front view of an assembled inner frame for a door panel of the present invention.

FIG. 2 shows one embodiment of an inner frame 12 of the door panel 10 of the present invention. The inner frame 12 includes a plurality of operably connected frame members 14 that according to one aspect of the invention have an identical cross-section. According to another aspect of the invention, each frame member 14 includes geometry capable of cooperating with a geometry of a door accessory for connection of the door accessory directly to the inner frame 12. The direct connection of the inner frame 12 and the door accessory includes an interconnecting geometry there between. In one embodiment, the interconnecting geometry between the inner frame 12 and the door accessory may include a channel and a ridge or a receptacle and a protrusion. The direct connection of the frame 12 and the door accessory may also, for example, utilize a press-fit, snap-fit, or friction-fit geometry.

A variety of door accessories capable of being operably attached to the door panel 10 are shown in FIGS. 3A-3C and 7 and include, but are not limited to: a leading edge gasket 16, a trailing edge gasket 18, a top edge gasket 20, a bottom edge gasket 22, a door guide 24, a connector to a trolley 62, and a window assembly 28.

Figure 4:
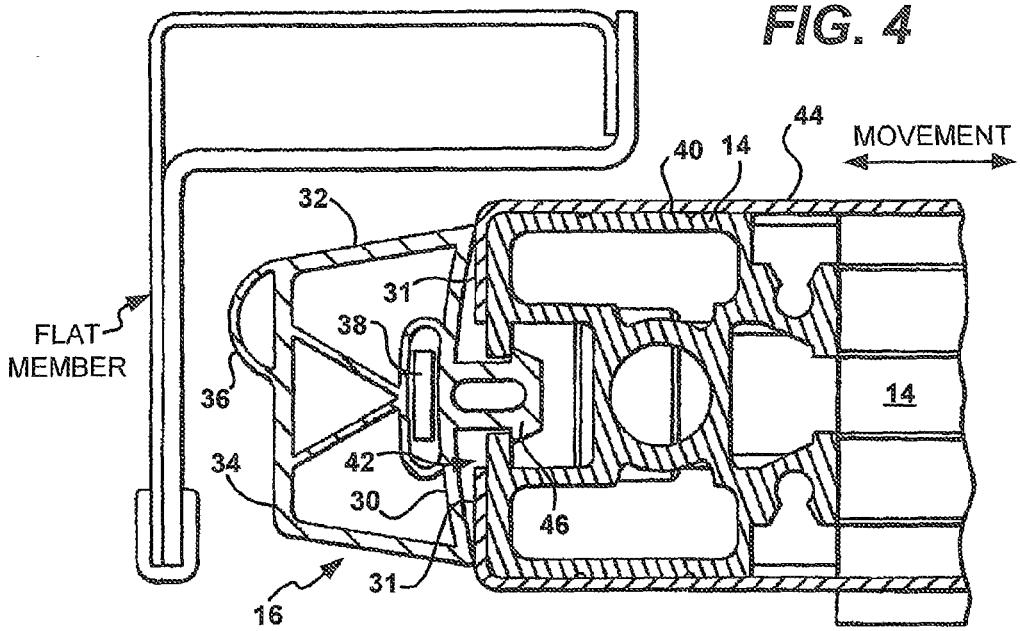
FIG. 4 is an enlarged view of a portion of the partial cross-sectional top view of the door panel of the present invention shown in FIG. 3A including a frame member and an operably attached leading door-edge gasket.
Figure 5:
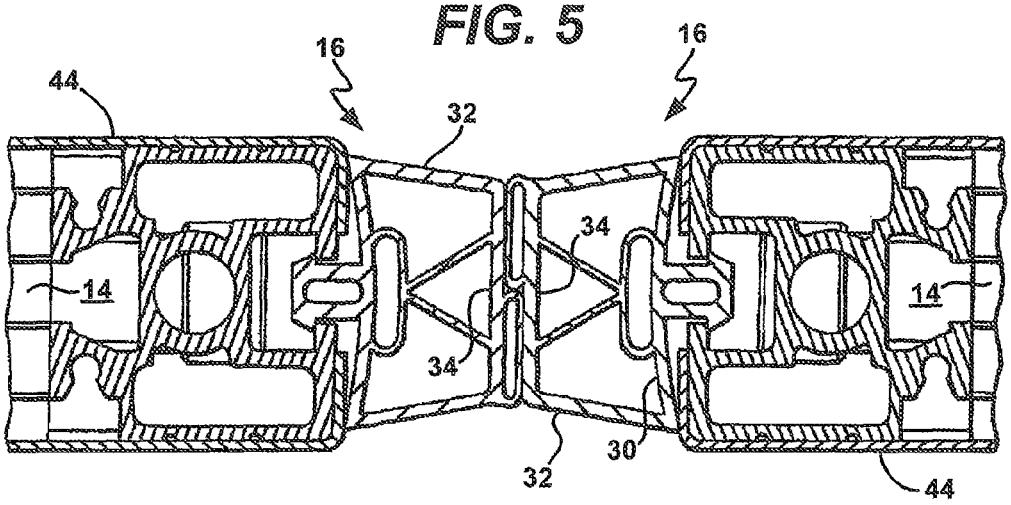
FIG. 5 is a partial view of a cross-section of a top view of cooperating door panels of the present invention, each door panel including a frame member and an operably attached leading door-edge gasket.

The leading edge gasket door accessory 16 shown in FIGS. 3A, 4, and 5 includes a base 30, a riser 32, and a crown 34. A protrusion, e.g., dome-shaped protrusion 36, may also extend from the crown 34. In a dual door panel assembly shown in FIG. 5, the dome 36 may be positioned off-center on the crown 34 of the leading edge gasket 16 to facilitate the operable sealing between the cooperating flat portion of the opposing leading edge gasket. In addition, a safety device such as an obstruction detection sensor 38 may also be incorporated with the leading edge gasket 16 and operably connected to the crown 34. The obstruction detection sensor is operably coupled to a drive mechanism of the door assembly such that contact of the leading edge gasket 16 with an object within the doorway will reverse the movement of the door panel.

Referring to FIG. 4, the inner frame 12 of the door panel 10 includes outer face surfaces 40 and outer edge surfaces 42. Sheet stock 44 is laid upon the inner frame surfaces 40 and preferably seals the inner frame 12 by overlapping the outer face surfaces 40. According to another aspect of the invention, the sheet stock 44 also extends over at least a portion of the outer edge surfaces 42 of at least a portion of the inner frame. The sheet stock 44 may be continuous and be made of plastic, metal, stainless steel, or other semi-rigid material. Further sealing of the door panel 10 can be attained by a door accessory, e.g., seal base 30, overlapping a portion of the sheet stock 44 that overlaps the outer edge surfaces 42 of the frame 12.

In cases where additional sealing is desired, according to one aspect of the invention, a moldable sealing material in the form of a caulk paste, liquid, or the like, may be placed between the seal base 30 and the sheet stock 44 overlapping the frame surfaces 42, for example, in the location identified by the reference number 31.

Each door accessory includes an integral connector portion 46 having a geometry capable of cooperating with the geometry of the inner frame 12 to operably attach the door accessory directly to the inner frame. The direct cooperation of the integral connector portion 46 of door accessory and the inner frame 12 includes an interconnecting geometry between the door accessory and the inner frame member 14. The interconnecting geometry between the inner frame member 14 and the door accessory may include a cooperating channel and a ridge or a receptacle and a protrusion.

Figure 6:
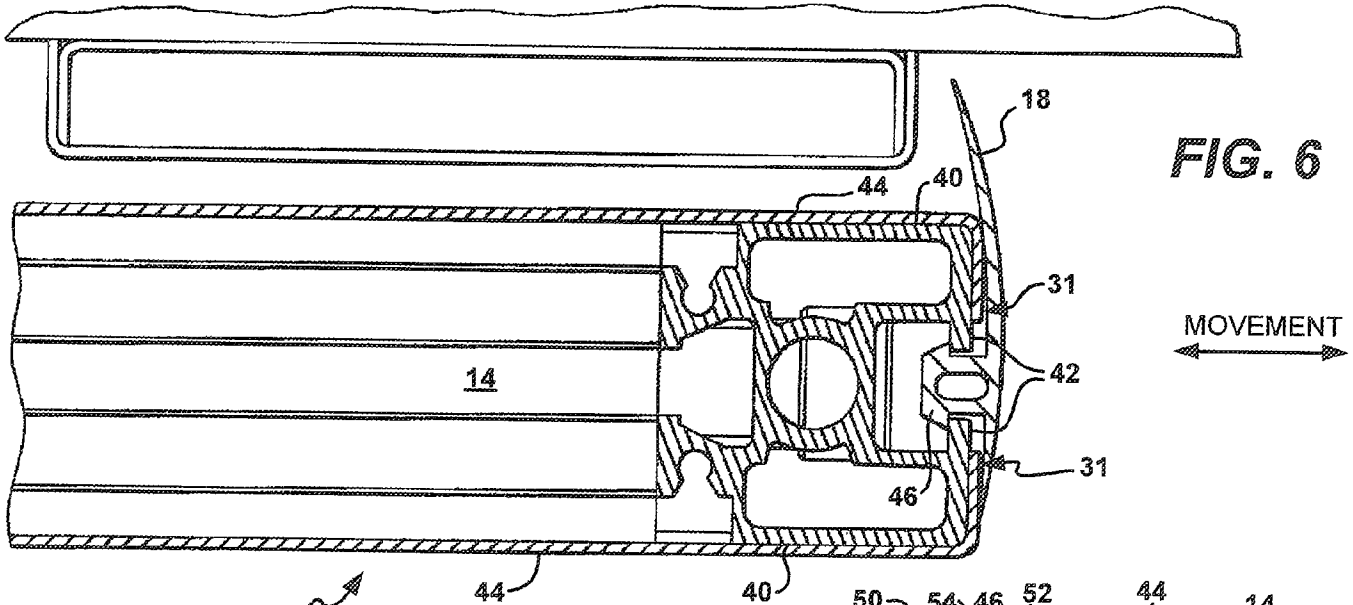
FIG. 6 is an enlarged view of a portion of the partial cross-sectional top view of the door panel of the present invention shown in FIG. 3A including a frame member and an operably attached trailing door-edge gasket.

Similar to the leading edge gasket door accessory, FIG. 6 depicts a trailing edge gasket 18 door accessory operably connected to the trailing edge of the door panel 10.

Figure 7:
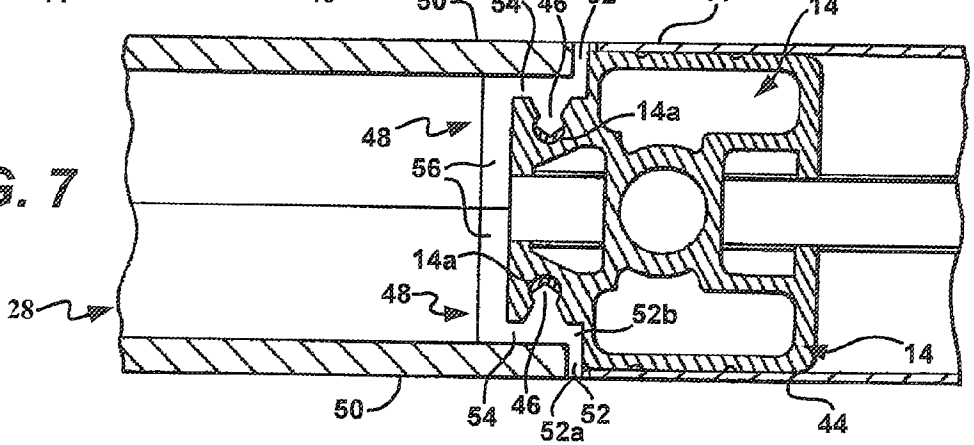
FIG. 7 is a partial view of a cross-section of a top view of the door panel of the present invention including a frame member and an operably attached window assembly.

Referring now to FIG. 7, another aspect of the present invention is depicted wherein the door accessory includes a gasket 48 for sealing a window within the door panel 12 of a slidable door assembly. The gasket 48 provides a seal between a transparent member(s) 50 and both the inner frame member 14 and the covering sheet stock 44. Preferably, an outer surface of the transparent member 50 is substantially coplanar with the sheet stock 44. The gasket 48 comprises a first sealing portion 52 including a proximate end 52*a* and a distal end 52*b*. Preferably, a terminal portion of the proximate end terminates substantially flush or coplanar with an outer surface of the sheet stock 44 and the outer surface of the transparent member 50. A second sealing portion 54 extends from the distal end 52*b* of the first sealing portion 52 and includes a portion that is substantially parallel to the transparent member 50. A third sealing portion 56 extends substantially perpendicular from the second sealing portion 54.

As with the other door accessories, the gasket 48 further includes an integral connector portion 46 adapted to cooperate with the geometry of the inner frame member 14 to attach the gasket 48 directly to the inner frame 12. The integral connector portion 46 defines a ridge geometry and the inner frame member 14 includes a mating channel 14*a* geometry formed therein. Alternately, the inner frame member 14 could define a ridge geometry in which case the integral connector portion 46 would include a mating channel geometry formed therein.

Figure 8:
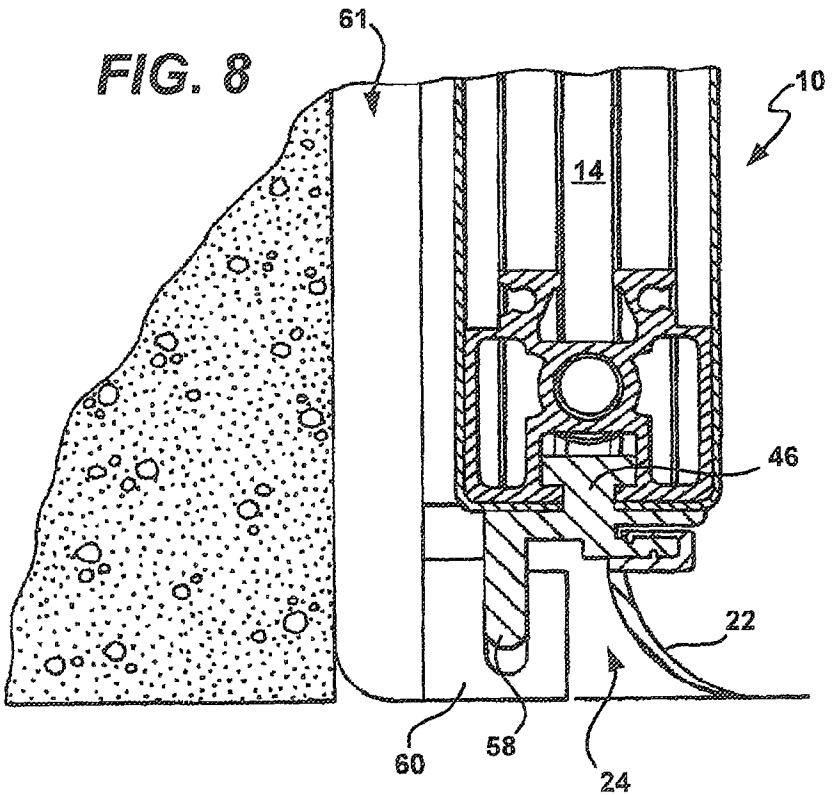
FIG. 8 is an enlarged view of a portion of the partial cross-sectional side view of the door panel of the present invention shown in FIG. 3C including a frame member and an operably attached guide; and, FIG. 9 is an enlarged view of a portion of the partial cross-sectional side view of the door panel of the present invention shown in FIG. 3B including a frame member and an operably attached trolley connector.

For a slidable door assembly including a header support positioned above the doorway and at least one vertical support for supporting for the header, another type of a door accessory is a guide 24. The guide 24 maintains alignment of the door panel 10 during sliding movement of the door panel. Referring to FIG. 8, the guide 24 comprises a first coupling member 58 and a second coupling member 60. The first coupling member 58 is operably attached to the slidable door panel 10 and the second coupling member 60 is operably attached to the vertical support 61 wherein the first coupling member and the second coupling member cooperate to maintain alignment of the door panel during movement of the door. While it is shown that the first coupling member 58 is a male-type and the second coupling member is a female-type, it is to be understood that utilization of a female-male relationship—as well as other geometric relationships—between the coupling members is considered to be within the scope of the present invention. A significant aspect and advantage is provided by having one part of the guide attached to the vertical column 61. This configuration allows for installation of a guide at the same time as installing the vertical support 61. This arrangement also provides for more OEM control over alignment of the door guide system.

The first coupling member 58 of the guide 24 similarly includes an integral connector portion 46 adapted to cooperate with the geometry of the inner frame member 14 to attach the guide directly to the inner frame 12. The direct connection of the integral connector portion 46 of first coupling member 58 and the door panel 10 includes an interconnecting geometry there between. A bottom edge gasket 22 may also be operably connected to the first coupling member 58.

Figure 9:
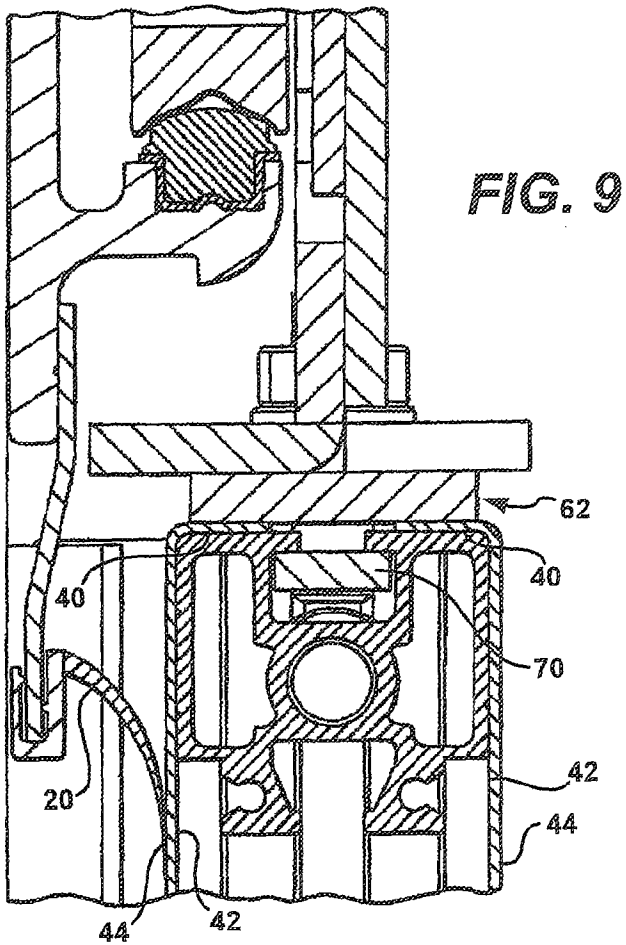

Yet another aspect of the present invention is shown in FIG. 9 and relates to a drive system for a slidable door assembly. The drive system comprises a trolley 62 including a geometry 70 that cooperates with the geometry of the inner frame member 14 for connection of the trolley directly to the inner frame 12. The direct cooperation of the inner frame 12 and the trolley 62 includes an interconnecting geometry there between, e.g., a protrusion and a receptacle, wherein the interconnection may be accomplished through a press-fit or snap-fit mechanism.

Preferably, the frame member 14 utilized in the construction of the door panel's inner frame 12 is an extrusion of material. The extruded frame member 14 has a length, a first side, and a second side and is capable of cooperating with various door accessories. The extruded frame member 14 includes at least one of either a first protrusion or a first receptacle formed in at least one of the first and second sides. The first protrusion or first receptacle is located and dimensioned to cooperate with a mating receptacle or protrusion of a door accessory. The extruded frame member 14 may also include a second protrusion or second receptacle that is different from the first protrusion and/or the first receptacle. The extruded frame member 14 may be symmetric or asymmetric about at least one axis and may further include a tube defined therein to facilitate a threaded, press-fit, or snap-fit connection between frame members.

There are many significant advantages of utilizing an extruded frame member 14. One such benefit may include cost savings obtained by reducing the amount of different components required during the construction of a door panel for a sliding door assembly. In addition, utilizing a common interface between the door panel and a variety of door accessories may facilitate design efforts.

While specific embodiments of the present invention have been illustrated and described, numerous modifications come to mind without significantly departing from the spirit of the invention, and the scope of protection is only limited by the scope of the accompanying claims.

What is claimed is:

1. A door panel for a slidable door assembly including a drive system, the door panel comprising:

an inner frame including multiple frame members forming an upper edge, a lower edge, and opposing side edges of the door panel, wherein each frame member has a substantially identical cross section, at least two integrally formed outer face surfaces, a first outer edge and a second outer edge integrally formed, at least one of a first receptacle or a first protrusion formed in one of the first outer edge or the second outer edge, the first receptacle or protrusion of each frame member extending along an entire length of the first or second outer edge and being exposed along one of the upper edge, the lower edge, or one of the opposing side edges of the door panel so that one receptacle or protrusion is exposed at each of the upper edge, lower edge, and opposing side edges of the door panel;

an accessory including a surface having a receptacle or protrusion that cooperates with the first receptacle or protrusion of one of the multiple frame members to connect the accessory directly to the inner frame; and sheet stock, the sheet stock substantially covering the outer face surfaces of each of the multiple frame members as well as a portion of the first or second outer edge of each of the multiple frame members, the portion of the sheet stock covering the outer edge of each of the multiple frame members not covering any portion of the first receptacle or protrusion extending along the first or second outer edge of the frame member.

2. The door panel of claim 1 wherein the accessory is a trolley.

3. The door panel of claim 1 wherein the accessory is a leading edge gasket.

4. The door panel of claim 1 wherein the accessory is a trailing edge gasket.

5. The door panel of claim 1 wherein the accessory is a guide mechanism.

6. The door panel of claim 5 further comprising a bottom edge gasket, the bottom edge gasket being coupled directly to the guide mechanism.

7. The door panel of claim 1 wherein the accessory connects to the inner frame using a press fitting.

8. The door panel of claim 1 wherein the accessory connects to the inner frame using a snap fitting.

* * * * *